US006306020B1

(12) United States Patent
Hed et al.

(10) Patent No.: US 6,306,020 B1
(45) Date of Patent: Oct. 23, 2001

(54) MULTI-STAGE SLURRY SYSTEM USED FOR GRINDING AND POLISHING MATERIALS

(75) Inventors: P. Paul Hed, San Ramon, CA (US); Baruch A. Fuchs, Aventura, FL (US)

(73) Assignee: The United States of America as represented by the Department of Energy, Washington, DC (US)

( * ) Notice: Subject to any disclaimer, the term of this patent is extended or adjusted under 35 U.S.C. 154(b) by 0 days.

(21) Appl. No.: 09/523,181

(22) Filed: Mar. 10, 2000

(51) Int. Cl.[7] ..... B24B 1/00
(52) U.S. Cl. ..... 451/60
(58) Field of Search ..... 451/8, 36, 60, 451/87, 88–99, 446, 447; 210/96.1, 87, 107, 196, 416.1, 167

(56) References Cited

U.S. PATENT DOCUMENTS 5,490,809 * 2/1996 Jones et al. ..... 451/60
5,755,614 * 5/1998 Adams et al. ..... 451/60
5,791,970 * 8/1998 Yueh ..... 451/446 X
6,126,531 * 10/2000 Iida et al. ..... 451/60 X
6,183,352 * 2/2001 Kurisawa ..... 451/60 X
6,189,621 * 2/2001 Vail, III ..... 166/385
6,203,412 * 3/2001 Quek ..... 451/60

* cited by examiner

*Primary Examiner*—Joseph J. Hail, III
*Assistant Examiner*—Anthony Ojini
(74) *Attorney, Agent, or Firm*—Gary R. Drew; William C. Daubenspeck; Virginia B. Caress

(57) ABSTRACT

A slurry system draws slurry from a slurry tank via one of several intake pipes, where each pipe has an intake opening at a different depth in the slurry. The slurry is returned to the slurry tank via a bypass pipe in order to continue the agitation of the slurry. The slurry is then diverted to a delivery pipe, which supplies slurry to a polisher. The flow of slurry in the bypass pipe is stopped in order for the slurry in the slurry tank to begin to settle. As the polishing continues, slurry is removed from shallower depths in order to pull finer grit from the slurry. When the polishing is complete, the flow in the delivery pipe is ceased. The flow of slurry in the bypass pipe is resumed to start agitating the slurry. In another embodiment, the multiple intake pipes are replaced by a single adjustable pipe. As the slurry is settling, the pipe is moved upward to remove the finer grit near the top of the slurry tank as the polishing process continues.

10 Claims, 3 Drawing Sheets

MULTI-STAGE SLURRY SYSTEM USED FOR GRINDING AND POLISHING MATERIALS

STATEMENT OF RIGHTS OF INVENTION

The United States Government has rights in this invention pursuant to Contract No. W-7405-ENG-48 between the United States Department of Energy and the University of California.

BACKGROUND OF THE INVENTION

1. Field of the Invention

This invention relates to apparatus and methods for grinding and polishing optical elements, such as lenses, prisms, windows, mirrors and similar optical systems. This invention could also be used to polish ceramics and semiconductor surfaces.

2. Description of the Related Art

A recirculating slurry system 10 of the prior art for grinding and polishing of optical parts is shown in FIG. 1. A slurry tank 12 holds a slurry 14, which usually consists of deionized water and grinding or polishing particles of fairly uniform size, and a pump 16. The slurry 14 is pumped from the tank 12 through pipe 18 to either a delivery pipe 24 or a bypass pipe 26. If valve 20 is open, the slurry 14 is returned to the slurry tank 12, which helps keep the grinding particles of the slurry 14 in suspension by agitation.

Valve 20 is usually kept open during the grinding and polishing phases, which include grinding away the surface roughness (stock removal) along with the subsurface damaged material (usually 7 times the depth of the surface roughness (peak-to-valley) is removed). When valve 22 is opened, the slurry 14 is pumped to the grinder/polisher 30, which grinds or polishes (depending on the size of the particles used) the surface of a part (not shown). For example, a loose abrasive grinding could be performed by using a grinder with a hard lap (metal or glass). The polishing could be performed by using a polisher with a resilient material such as pitch or polyurethane. The part being ground and polished could be an optical lens or a semiconductor blank inserted in the grinder/polisher 30. During the final polishing stage, the valve 20 is usually shut or partially closed to allow the slurry to begin to settle. The slurry in the grinder/polisher 30 is returned to the slurry tank 12 via return pipe 28. It is desirable to shut valve 22 after polishing the part is complete so that slurry will circulate through bypass pipe 26 in order to avoid the settling and caking of the polishing compound.

The loose abrasive grinding used in the slurry is typically an aluminum oxide or silicon carbide with mean grit sizes between 9–30 $\mu$m. Polishing slurry usually uses cerium oxide or zirconium oxide with a mean grit sizes between 1–3.5 $\mu$m. For polishing slurries, the range of polishing powders on the market is usually between 0.4 to 3.7 $\mu$m APS (average particle size). However, a compound with a specific particle size will have a range of different sized particles based on standard distribution curves. For example, a 2.5 $\mu$m APS compound has particles ranging from 0.5 to 8.0 $\mu$m in size. Although the larger particles may be a weak agglomeration of smaller particles, the surface of the polished object may be scratched if the larger particle do not break apart. In another example, a 12.5 $\mu$m APS compound was tested to find that the size of the particles ranged from 7 to 25 $\mu$m and some particles were as large as 40 $\mu$m. Although these very large particles will most likely create scratches, these particles fortunately either settle down quickly or are too large to penetrate between the lap and the part being polished.

In order to avoid some of these problems, manufacturers perform two polishing operations: the so called "pre-polishing" process and the "final polishing" process. This is time consuming method of polishing parts because it requires each part to be removed, washed, and transferred into the final polishing machine.

FIG. 2 shows another recirculating slurry system 40 of the prior art where the pump 46 is located outside of the slurry tank 42. The slurry 44 held in the slurry tank 42 is removed via pipe 48 and valve 50. The slurry is pumped via pipe 56 to either delivery pipe 60 via valve 58 or bypass pipe 52 via valve 54. The grinder/polisher 62 receives the slurry 44 from delivery pipe 60 and returns the slurry to the slurry tank via return pipe 64.

The recirculating slurry systems shown in FIGS. 1 and 2 will pump relatively rough grit into the attached polisher. While this is advantageous during most of the polishing or grinding process, it is objectionable during the final stages of the polishing because the surface finish of substrates depends on the grit size being used. Instead of removing the partially polished part to insert into a separate "final polishing" machine, the lap is flushed with deionized water to perform a "water polishing" step. It is commonly believed that the remaining polishing particles will embed themselves in the lap material, thus exposing just the tips of the grains, which are obviously smaller than the whole slurry grains. Thus, a finer polished surface will result. However, the pH of the deionized water (pH of 7) is usually different than the optimal value for the slurry. Therefore, the slurry compound will begin to aggregate and the continued polishing of the part will create scratches. It has been demonstrated that just 15 minutes of "water polishing" deteriorates the part's surface and scratches may appear after 30 minutes. In addition, the unnecessary water added to the slurry tank will change the density of slurry and affect the polishing of subsequent parts.

The recirculating slurry systems shown in FIGS. 1 and 2 can produce an optical part with a smoothness of only 4–5 Å RMS.

SUMMARY OF THE INVENTION

The present invention discloses a slurry system that draws slurry from a slurry tank via one of several intake pipes. Each intake pipe has an intake opening at a different depth in the slurry tank. The process begins by continuously removing slurry from the intake pipe with an intake opening at the deepest level. The slurry is returned to the slurry tank via a bypass pipe in order to continue the agitation of the slurry. The slurry is then diverted to a delivery pipe, which supplies slurry to the polisher. When the surface roughness is smoothed out, the flow of slurry in the bypass pipe is stopped in order for the slurry in the slurry tank to begin to settle. As the polishing continues, slurry is removed from different pipes so that the final pipe is at the shallowest depth such that the finest grit is pulled from the slurry. When the polishing is complete, the flow of the slurry in the bypass pipe is resumed to start agitating the slurry and the intake pipe with the intake opening at the deepest level is used again.

The present invention also discloses a slurry system that draws slurry from a slurry tank via an adjustable intake pipe. The process begins by continuously removing slurry from the intake pipe at a predetermined level. The slurry is returned to the slurry tank via a bypass pipe in order to continue the agitation of the slurry. The slurry is then diverted to a delivery pipe, which supplies slurry to the polisher. The flow of slurry in the bypass pipe is stopped in order for the slurry in the slurry tank to begin to settle. As the polishing continues, the adjustable intake pipe is adjusted such that slurry is removed from predetermined levels where each level is shallower than the previous level. When the polishing is complete, the flow of slurry in the bypass pipe is resumed to start agitating the slurry and the intake pipe is returned to its original position.

An object of the invention is to provide progressively finer polishing grit to a polisher.

Another object of the present invention is to avoid using water as a final polishing step when polishing surfaces of optical ceramic and semiconductor elements.

Other objects and advantages of the present invention will become apparent when the apparatus of the present invention is considered in conjunction with the accompanying drawings, specification, and claims.

BRIEF DESCRIPTION OF THE DRAWINGS

For a better understanding of the invention and further features thereof, reference is made to the following detailed description of the invention to be read in connection with the accompanying drawings, wherein.

DESCRIPTION OF THE PREFERRED EMBODIMENT

While this invention is described in some detail herein, with specific reference to illustrated embodiments, it is to be understood that there is no intent to be limited to these embodiments. On the contrary, the aim is to cover all modifications, alternatives and equivalents falling within the spirit and scope of the invention as defined by the claims. For example, three pipes are used to pull slurry from the slurry tank at different depths. However, any number of pipes could be used. As another example, the preferred embodiments will be used for polishing the parts; however, the preferred embodiments can also be used for grinding a part by adjusting the characteristics of the slurry.

Figure 1:
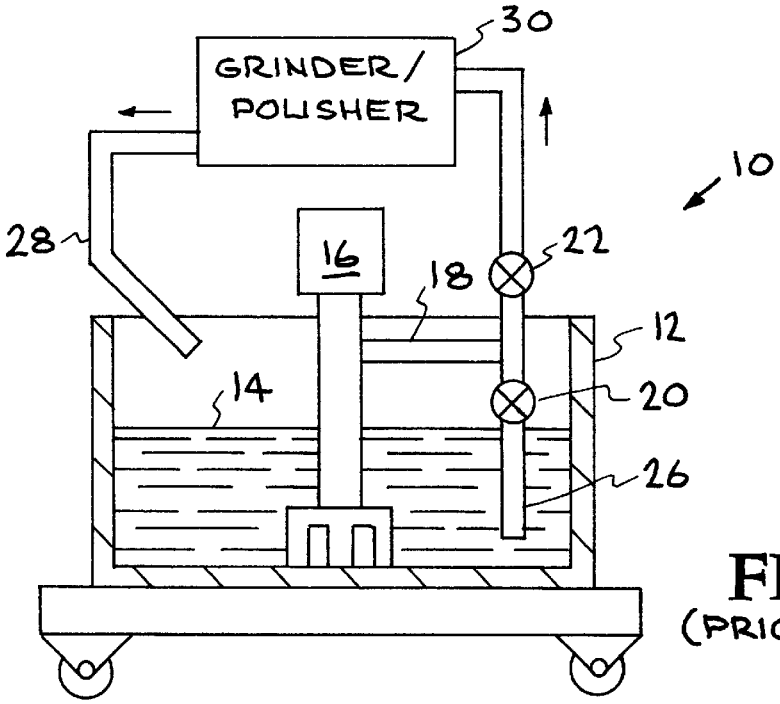
FIG. 1 (PRIOR ART)
FIG. 1 depicts a prior art recirculating slurry system.
Figure 2:
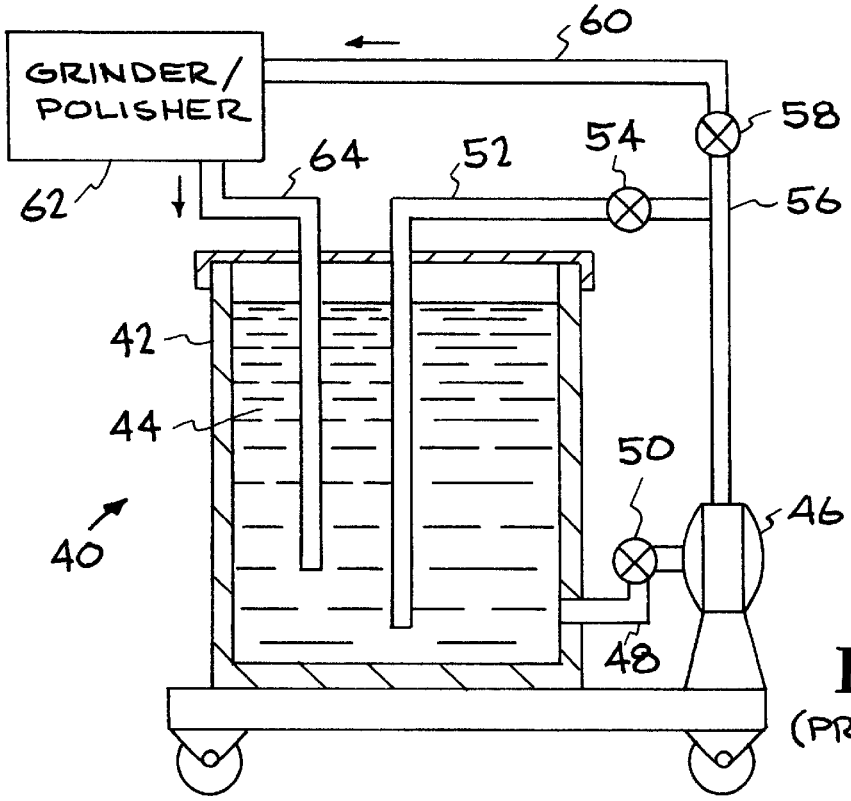
FIG. 2 (PRIOR ART)
FIG. 2 depicts another recirculating slurry system known in the prior art.
Figure 3:
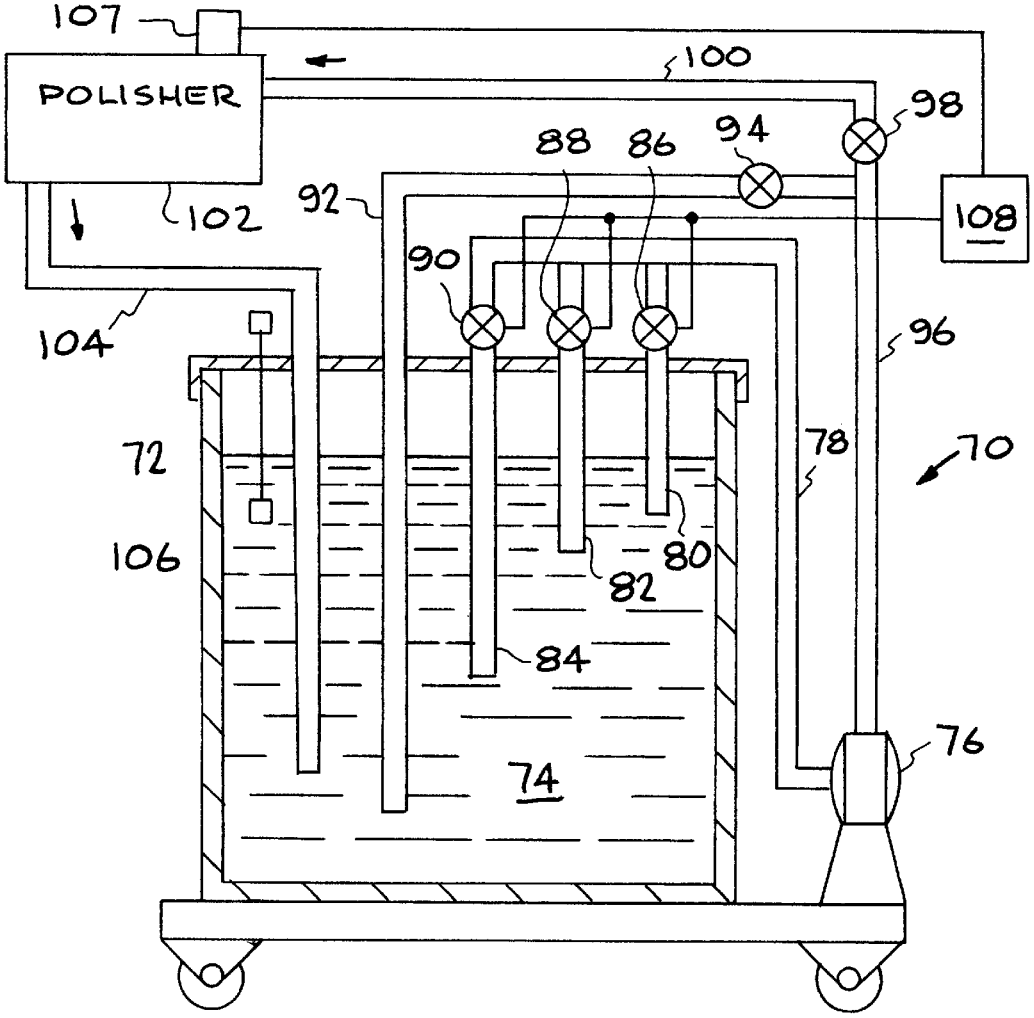
FIG. 3 shows a recirculating slurry system of the present invention described as the first preferred embodiment.

Referring to FIG. 3, a multi-stage recirculating slurry system 70 of the first preferred embodiment of the present invention is shown. The slurry tank 72 holds slurry 74, which consists of grit of different sized particles. Pump 76 pumps slurry 74 from the tank 72 via one of several pipes or pipes. In this first preferred embodiment, there are three pipes 80, 82, 84, which each have an intake opening that is at a different depth in the slurry 74. As grit settles down when undisturbed, larger particles settle faster than smaller ones. The settling time depends on Stoke's law, that is, the settling time is directly proportional to the liquid viscosity and inversely proportional to the square of the grain diameter. Therefore, the ideal depths of these intake openings can be determined based on the amount and rate of slurry material to be removed. Thus, it can be predetermined that pipe 84 will pull larger grit than pipe 82, and pipe 80 will pull the finest grit. The valves 86, 88, 90 control the flow of slurry in corresponding pipes 80, 82, 84. Only one valve is open at a time providing grit of a specific mean size to pipe 96. If valve 94 is open, then the grit is recirculated via bypass pipe 92 in order to agitate the slurry. If valve 98 is open, then the grit will be pumped to the polisher 102 via pipe 100. The grit is returned to the slurry tank 72 via return pipe 104. However, valve 98 is closed during non-operational periods to continue slurry agitation in order to prevent caking of the slurry compounds in the tank.

To polish the surface of an optical part or semiconductor substrate, the following operation of the multi-stage recirculating slurry system 70 will occur. During the rough polishing process, where most of the subsurface damage is removed, the bypass pipe valve 94, valve 98 and the valve 90 of the deepest pipe 84 are open. Thus the grit is being agitated in the slurry tank 72 and pumped to the polisher 102. After the polishing has achieved a certain level of smoothness, the bypass pipe valve 94 is closed, thus allowing the grit to start settling down in the slurry tank 72. The bypass pipe valve 94 could be partially closed to slow the settling of the grit by allowing some slurry agitation to occur. After a specific time interval, which will be established by the requirements of the polisher 102, valve 90 is closed and the next valve 88 will be opened to allow grit from the depth of pipe 82 to be drawn. The slurry continues to settle during this polishing process. After another time interval, valve 88 is closed and valve 86 is opened to allow slurry to be drawn via the shallowest pipe 80. Because the slurry has settled and the heavy particles have drifted toward the bottom of the slurry tank 72, only very fine particles will be pumped into the polisher 102. When the polishing is complete, the polished part can be removed from the polisher. Usually, valve 98 remains open during operation in order to allow the lap to remain at a constant temperature in order to avoid the lap from warping. This is especially important with pitch laps, where the temperature affects the viscosity of the lap, and ultimately affects the geometric accuracy of the substrates and their smoothness. Bypass valve 94 is opened to recirculate the slurry and hence agitate the slurry to mix the particles. A new part can be inserted in the polisher to start the process again.

During the polishing process, the pH of the slurry should be carefully monitored. For example, the slurry could be monitored with a pH meter 106 or by installing a pH compensator into the tank. Although suspension agents are added to the slurries to retard settling and to prevent caking of settled polishing compounds, the changing pH of the slurry can have a significant impact on the characteristics of the slurry. For example, some polishing compounds totally lose their suspension properties and settle hard when the proper pH is not maintained. Another problem is when some types of glass may be etched or leached during polishing. Most glass by its composition is alkaline. Therefore, the polishing slurry becomes progressively more alkaline as the part's surface residue (swarf) is mixed into the slurry. In contrast, both heat-absorbing glass and the continuously abraded lap pitch are acidic. Thus, the pH of the slurry changes as the percentage of these by-products of the polishing process increase. Another concern is that some polishing compounds have a higher stock removal in certain pH ranges. So by adjusting the pH level, there will be an increase or decrease in the amount of removal of the part.

For example, the proper pH for fused silica is 4.0. When performing polishing of fused silica substrates, the removal rate was the highest at this pH value and so was the resulting surface finish. It was also discovered that when the pH was at a different value, there was a significant amount of undesirable redeposition of material on the substrate surface.

In addition to adjusting the pH of the slurry to keep it from aggregating, a perforated pipe (not shown) located at the bottom periphery of the tank could be used to blow air bubbles into the slurry to continuously agitate it. Another method to assist in agitating the slurry is to use a conical-shaped tank (not shown) with a tapered angle of 60 degrees with the pump located in the center of the cone.

Each of the valves described in the first preferred embodiment could be manually operated. However, a controller 108 as shown in FIG. 3 could be used to automatically control each of the valves in the correct sequence. Also, a gauge 107 could be used in the polisher 102 that measures the amount of removed stock. Thus, the controller 108 would wait until the lens or substrate reached a predetermined specification before opening and closing the appropriate valves. An alternative to using a gauge is to measure a "monitor," which is a part that is being worked along with the real parts. The monitor is removed from the machine for measurement purposes.

The first preferred embodiment eliminates the necessity of having "pre-polishing" process and the "final polishing" process. The entire polishing process is done continuously to achieve a part surface smoothness in the 2 Å RMS level. This is remarkably smooth for a 48" diameter CP machine. However, the process should be able to achieve 1 Å RMS smoothness or better, in elements with the proper monitoring of pH, slurry composition and other factors described above.

Figure 4:
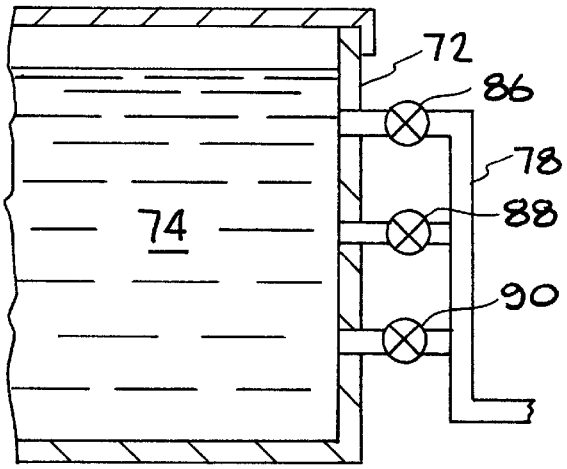
FIG. 4 shows an alternate method of extracting the slurry from the tank in the first preferred embodiment.

A slightly modified design for extracting the slurry from the tank is shown in FIG. 4 as the second preferred embodiment. The intake pipes are attached to the wall of the tank 72. Each intake pipe is positioned at the appropriate depth for removing the different sized grit. Similar to the previous description for the first preferred embodiment, valve 90 would be open when recirculating the slurry. After the bypass valve 94 (see FIG. 3) is closed, the grit in the slurry 74 begins to settle. Valve 90 will then be closed and valve 88 is opened allow grit at the higher level to be extracted from the tank 72. After another time interval, valve 88 is closed and valve 86 is opened to allow slurry to be extracted via the highest level of the tank. The appropriate valves are adjusted for recirculating the slurry after the polishing is complete.

An alternate design of the first preferred embodiment could be to position the intake pipes at the bottom of the tank. Therefore, the intake would be at the same height as in the first preferred embodiment, but the slurry would be drawn under the tank and sent to the polisher.

Figure 5:
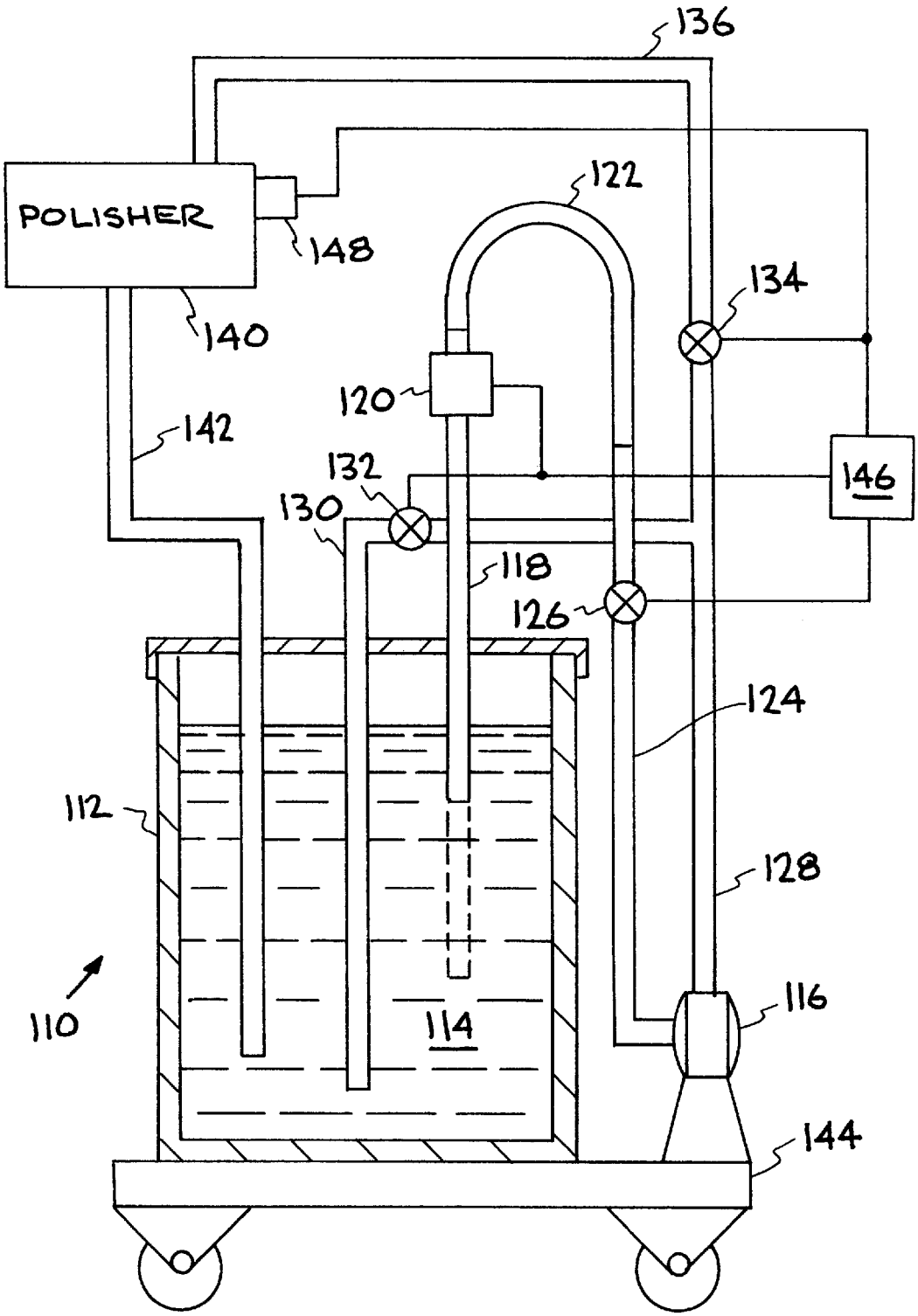
FIG. 5 shows a recirculating slurry system of the present invention described as the second preferred embodiment.

Referring to FIG. 5, multi-stage recirculating slurry system 110 of the third preferred embodiment of the present invention is shown. The slurry tank 112 holds slurry 114, which consists of grit of different size particles. Pump 116 pulls slurry 114 from the tank 112 via pipe 11 8. In this third preferred embodiment, the depth of this pipe 118 is adjusted via a motor 120. Therefore, grit can be removed at any level within the slurry. When valve 126 is open, the slurry 114 flows through pipe 118, a flexible hose 122 and pipe 124 to the pump 116. If valve 132 is open, then the grit is recirculated via bypass pipe 130 and the slurry will be continuously agitated. If valve 134 is open, then the grit will be pumped to the polisher 140 via pipe 136. The grit is returned to the slurry tank 112 via return pipe 142.

Similar to the first preferred embodiment, both the bypass pipe valve 132 and the valve 126 are open to keep the slurry 114 in an agitated state. The motor 120 moves the adjustable pipe 118 toward the bottom of the slurry tank 112. Valve 134 is opened to begin sending particles of different sizes to the polisher 140. As the polishing continues, valve 132 is closed so that the slurry begins to settle. The motor 120 can either move the adjustable pipe 118 to specific levels or continuously move the pipe upwards at a predetermined rate. As the pipe 118 is moved to a shallower depth, finer particles are pumped to the polisher 140. The larger particles in the polisher 140 are returned to the slurry tank 112 via pipe 142. When the polishing is complete, the bypass valve 132 is opened to recirculate the slurry and hence agitate the slurry to mix the particles of grit.

Similar to the first preferred embodiment, each of the valves could be manually operated. Instead of a motor 120 to adjust the adjustable pipe 118, a clamp could be used. However, it is preferable to use a controller 146 that automatically controls each of the valves in the correct sequence. The controller 146 would also operate the motor 120 to adjust the pipe 118 to the appropriate level. Also, a gauge 148 could be used in the polisher 140 that measures the amount of stock that has been removed. Thus, the controller 146 would wait until the lens or substrate reached a predetermined specification before opening and closing the appropriate valves and adjusting the depth of the pipe 118. Also, the multi-stage recirculating slurry system 110 could be mounted on a rolling stand 144 to assist in moving the system.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

What is claimed is:

1. A multistage recirculating slurry system for providing different sized grit to a polisher, comprising:

a tank for holding a slurry of said different sized grit;

an adjustable intake pipe for extracting slurry from said tank, said adjustable intake pipe having at least two positions that are at different depths in said tank;

an intake valve coupled to said adjustable intake pipe for controlling a flow of slurry through said adjustable intake pipe;

a bypass pipe coupled to said adjustable intake pipe for returning slurry to said tank;

a bypass valve coupled to said bypass pipe for controlling a flow of slurry in said bypass pipe;

a delivery pipe coupled to said adjustable intake pipe for supplying slurry to said polisher;

a delivery valve coupled to said delivery pipe for controlling a flow of slurry in said delivery pipe;

a return pipe coupled to said polisher for returning said slurry from said polisher to said tank;

a pump coupled to said adjustable intake pipe for pumping the slurry in said bypass pipe and said delivery pipe.

2. A multistage recirculating slurry system of claim 1, wherein a motor moves said adjustable intake pipe to said different depths in said tank.

3. A multistage recirculating slurry system of claim 1, wherein a clamp is used to hold said adjustable intake pipe to said different depths in said tank.

4. The multistage recirculating slurry system of claim 1 further including a controller for controlling the operation of said bypass valve, said intake valve, said delivery valve and said motor.

5. The multistage recirculating slurry system of claim 4, wherein said controller adjusts said valves and said motor based on predetermined time intervals.

6. The multistage recirculating slurry system of claim 4 further including a gauge coupled to said polisher, wherein said controller adjusts each of said valves and said motor based on signals from said gauge.

7. The multistage recirculating slurry system of claim 1, wherein said grit is a polishing compound comprising at least one of cerium oxide and zirconium oxide.

8. The multistage recirculating slurry system of claim 1, wherein said adjustable intake pipe includes a flexible pipe coupling an opening in said adjustable intake pipe that extracts the slurry from the tank to the bypass pipe, said delivery pipe and said pump.

9. A multistage recirculating slurry system for providing different sized grit to a polisher, comprising:

a tank for holding said slurry of different sized grit;

first means for extracting from at least two different depths said slurry from said tank;

second means coupled to said first means for returning slurry to said tank;

third means coupled to said first means for supplying slurry to said polisher;

pumping means for pumping said slurry through said first means, second means and third means; and a controller for adjusting a flow of said slurry in said first means, second means and third means.

10. A process of supplying a slurry of different sized grit to a polisher that is polishing an object, said process comprising the steps of:

removing slurry from a tank via an intake pipe at a predetermined depth in said slurry;

returning slurry to said tank via a bypass pipe such that said different sized grit in said slurry remains agitated in said tank;

diverting slurry from said bypass pipe to a delivery pipe such that slurry is supplied to said polisher;

stopping a flow of said different sized grit through said bypass pipe such that said different sized grit in said tank begins to settle;

removing slurry from said tank at different predetermined depths in order to remove finer grit of said different sized grit as slurry extraction progresses;

stopping a flow of slurry through said delivery pipe; and starting a flow of slurry through said bypass pipe to commence agitating said slurry in said tank.

* * * * *